US005839041A

United States Patent [19]

Condello et al.

[11] Patent Number: 5,839,041

[45] Date of Patent: Nov. 17, 1998

[54] RAM SYSTEM INCLUDING A BIDIRECTIONAL METERING MEMBER AND A DUAL PURPOSE SWIPER BLADE

[75] Inventors: Anthony S. Condello, Webster; Robert M. Jacobs, Ontario; Rabin Moser, Victor, all of N.Y.

[73] Assignee: Xerox Corporation, Stamford, Conn.

[21] Appl. No.: 936,216

[22] Filed: Sep. 29, 1997

[51] Int. Cl.[6] ..... G03G 15/20

[52] U.S. Cl. ..... 399/325; 118/60

[58] Field of Search ..... 399/324–326; 118/60, DIG. 1

[56] References Cited

U.S. PATENT DOCUMENTS 5,212,527 5/1993 Fromm et al. ..... 399/326

5,356,473 10/1994 Fromm ..... 118/60

5,504,566 4/1996 Chow et al. ..... 399/320

5,634,184 5/1997 Dalal et al. ..... 399/325

*Primary Examiner*—William Royer

[57] ABSTRACT

A RAM system including a metering roll and a pair of metering blades, is positioned in contact with a metering roll at a location intermediate, a nip formed through pressure contact of the metering roll with a donor roll, and a supply of release agent material such that as the metering roll is rotated in the imaging process direction release agent material is metered onto the metering roll and contaminants are prevented from getting deposited on the fuser roll. A second metering blade contacts the metering roll at a location that is intermediate the aforementioned nip and the supply of release agent such that when the metering roll is rotated in the direction opposite to the process direction excess release agent material and/or contaminants are prevented from being deposited on the fuser roll.

20 Claims, 2 Drawing Sheets

RAM SYSTEM INCLUDING A BIDIRECTIONAL METERING MEMBER AND A DUAL PURPOSE SWIPER BLADE

BACKGROUND OF THE INVENTION

This invention relates generally to heat and pressure fusers for electrophotographic printing machines, and more particularly to a Release Agent Management (RAM) system therefor.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to the donor roll is then deposited on latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip.

The heated fuser roll is usually the roll that contacts the toner images on a substrate such as plain paper. In any event, the roll contacting the toner images is usually provided with an adhesive material for preventing toner offset to the fuser member. Three materials which are commonly used for such purposes are PFA™, Viton™ and silicone rubber. All of these materials, in order to maintain their abhesive qualities, require release agents specific to the material.

Various methods are known for applying release agent materials to a fuser member such as a heated fuser roll. One such system comprises a Release Agent Management (RAM) system including a donor roll which contacts the fuser member to which the oil or release agent material is applied. The donor roll also contacts a metering roll which conveys the oil from a supply of oil to the donor roll. A blade member is provided for metering oil on the metering roll.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 5,504,566 granted to Chow et al on Apr. 2, 1996 discloses an apparatus for fusing toner images to a substrate. A Release Agent Management (RAM) system for applying silicone oil to a metering roll utilizes a pair of metering blades to improve oil uniformity on the metering roll. Thus, streaks or localized areas of excess silicone oil as the result of blade defects and/or dirt accumulation associated with a first blade, are metered or smoothed to a more uniform thickness by the second blade. To this end, the first metering blade serves to meter silicone oil to a first predetermined thickness while the second blade serves to meter oil streaks to a second predetermined thickness which is greater than the first predetermined thickness.

U.S. Pat. No. 5,212,527 granted to Fromm et al on May 18, 1993 discloses a release agent management (RAM) system including a metering roll supported for contact with release agent material contained in a sump. A donor roll is provided for applying oil deposited thereon by the metering roll. A metering blade structure for metering silicone oil onto the metering roll has two modes of operation. In one mode, a wiping action of a metering blade meters a relatively large quantity of silicone oil to the roll surface for accommodating the fusing of color toner images. In another mode of operation, a doctoring action is effected for metering a relatively small amount of silicone oil to the roll surface for accommodating the fusing of black toner images.

BRIEF SUMMARY OF THE INVENTION

According to the intents and purposes of the present invention, which are to provide a structure and method for uniformly metering oil in a RAM system as well as preventing the deposition of excess release agent material and/or contaminants on a fuser member during jam clearance, there is provided a RAM system including a metering roll and a pair of metering blades. One of the blades corresponds to the conventional single blade used in prior art donor/metering RAM systems. As in the case of the prior art RAM system this blade is positioned in contact with the metering roll at a location intermediate a nip formed between the donor roll and the metering roll and a quantity of release agent on the metering roll picked up from a supply of release agent such that as the metering roll is rotated in the process direction the release agent material is satisfactorily metered onto the metering roll and contaminants are prevented from being deposited on the fuser roll.

A second metering blade contacts the metering roll at a location that is intermediate the nip and a quantity of release agent on the metering roll picked up from a supply of release agent such that when the metering roll is rotated in the direction opposite to the process direction excess release agent material and/or contaminants are prevented from being deposited on the fuser roll.

In the embodiment to be described in detail hereinafter the nip is located at about the 10 o'clock position relative to the metering roll. The supply of release agent material is located at the 6 o'clock position and one of the metering blades is located at about the 2 o'clock position while the other blade is located at about the 8 o'clock position. This arrangement insures that there is a metering blade disposed intermediate the donor/metering roll nip and a quantity of release agent material on the metering roll which has been removed from the supply of release agent material regardless of direction of rotation of the metering roll.

DESCRIPTION OF THE PREFERRED EMBODIMENT(S) OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 2:
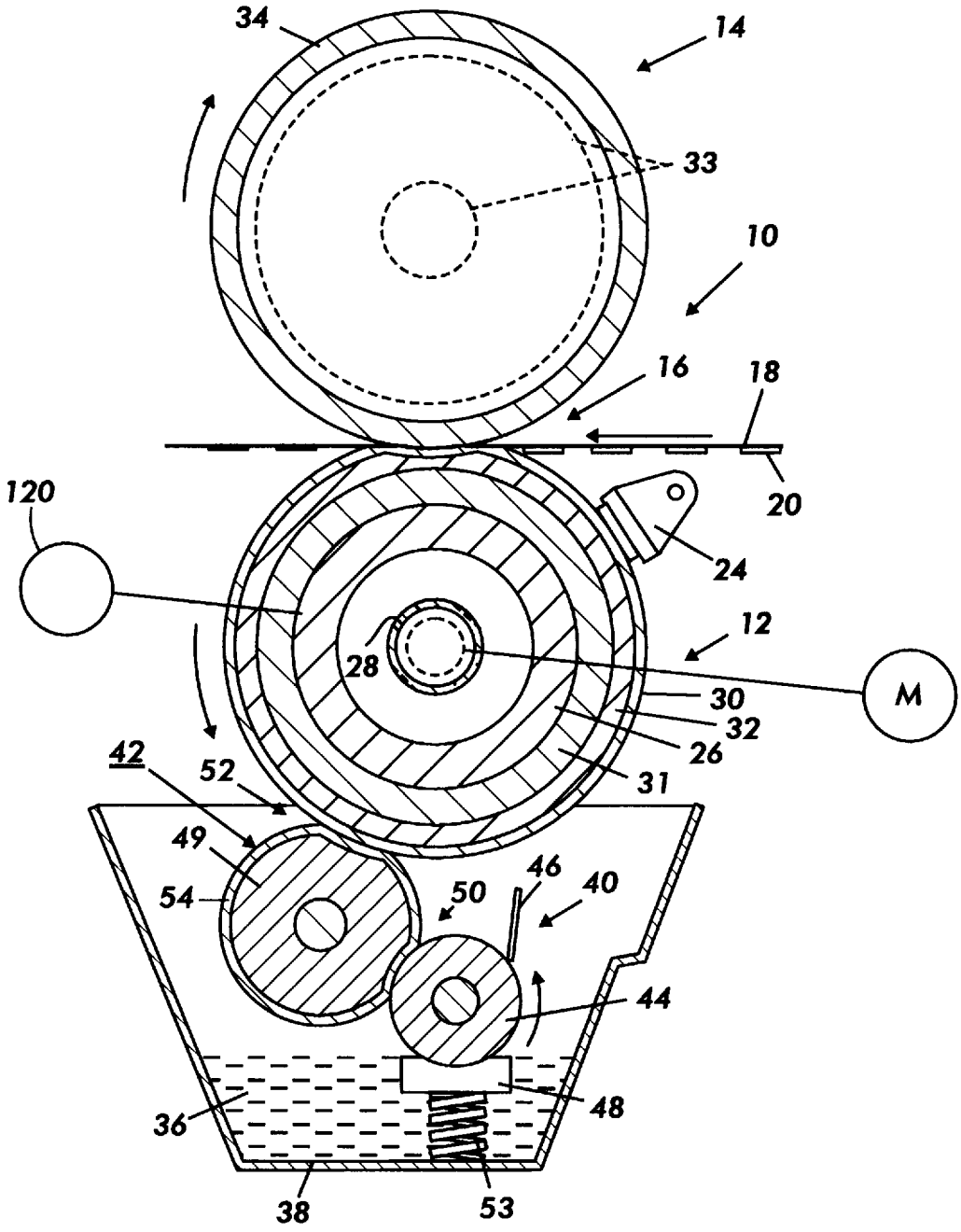
FIG.2 PRIOR ART
FIG. 2 is a schematic representation of a prior art.

For a general understanding of the features of the present invention, reference is made to the drawings. In the drawings, like reference numerals have been used throughout to identify identical elements. FIG. 2 discloses a multi-layered Nip Forming Fuser Roll (NFFR) fuser structure generally indicated by reference character 10. The fuser apparatus comprises a heated roll structure 12 cooperating with a non-heated backup roll structure 14 to form a nip 16 through which a copy substrate 18 passes with toner images 20 formed thereon in a well known manner. The toner images 20 contact the heated roll structure while a force is applied between the roll structures in a well known manner to create pressure therebetween resulting in the deformation of the heated fuser roll structure by the nonheated pressure roll structure to thereby form the nip 16.

As the substrate passes out of the nip, they are generally self stripping except for very light weight ones. These substrates require a guide to lead them away from the fuser roll. After separating from the fuser roll, substrates are free to move along a predetermined path toward the exit of the machine (not shown) in which the fuser structure apparatus 10 is to be utilized.

A contact temperature sensor 24 is provided for sensing the surface temperature of the roll structure 12 and in conjunction with conventional circuitry (not shown) maintains the surface temperature to a predetermined value, for example, on the order of 375°–400 ° F. The heated roll structure 12 comprises a hollow cylinder or core 26 having a radiant quartz heater 28 disposed in the hollow thereof. When suitably energized via the aforementioned circuitry, the heating element radiates heat to the cylinder which is then conducted to the outer surface. The fuser roll is constructed of multiple layers. The first layer attached to the core is generally a conductive silicone rubber having a conductivity in the order of 0.4 to 0.7 w/m °C. In order to prevent penetration of silicone oil into the base layer, two layers of Viton are used. A first layer of 40 $\mu$m of Viton is a thermally conductive Viton in the order of 0.25 to 0.4 w/m °C. The outer layer of 10 $\mu$m of Viton is relatively non-conductive, smooth-surfaced outer layer 30 of the structure 12. The layer 30 preferably comprises Viton™ (trademark of E. I. du Pont Nemours & Co. for a fluoroelastomer based on the copolymer of vinylidene fluoride and hexafluoropropylene) which is relatively thin, having a thickness of about 10$\mu$. The conductivity of the outer layer is about 0.17 w/m °C.

A base layer 31 which is adhered to the core 26 comprises a relatively thick layer of conductive silicone rubber. A typical thickness for base layer 31 is in the order of 1–3 mm, the conductivity thereof being in the order of 0.5–0.8 w/m °C. The conductivity of the base member is effected in a conventional manner by adding conductive materials to the silicone rubber. The conductive silicone rubber layer retains sufficient deformability to be used in a NFFR structure notwithstanding the presence of the conductive material.

An inner layer 32 adhered to both the outer layer 30 and inner layer 31 has an intermediate thickness of about 40 $\mu$m and like the outer layer 30 is fabricated from Viton™. However, unlike the outer layer 30, the inner layer 32 is rendered thermally conductive using appropriate metallic and/or non-metallic fillers well known in the art to provide a conductivity in the order of 0.25–0.4 w/m °C. The layers of Viton™ and silicone rubber are fabricated and adhered to each other by various techniques known in the prior art. For example, the Viton™ layers may be formed by spraying or flow coating while the silicone rubber layer may be molded. The base layer with the outer and inner layers adhered thereto is adhered to the core 26 in any suitable manner. Viton™ is rendered abhesive by the use of appropriate functional silicone oils such as Mercapto or amino oils.

The Viton™ outer layer 30 together with the inner Viton layer 32 form a barrier layer between the layer 31 and a substrate carrying toner images for preventing oil penetration into the base layer while allowing adequate heat flow therethrough thereby enabling the NFFR to be utilized for high speed fusing of color toner images.

The outer and inner layers 30 and 32 exhibit good release, durability and produce high gloss toner images with only a minimal impedance to heat dissipation compared to prior art devices. The inner conductive layer 32 and the base layer 31 provide for excellent transfer of thermal energy from the heat source 28.

The backup roll structure 14 comprises a metal core 33 to which is adhered a relatively thin layer 34 of a suitable abhesive material. The layer 34 may be provided with a sleeve of suitable material (not shown). Due to the relative constructions of the heated or fuser roll structure 12 and backup or pressure roll structure 14, the fuser roll is deformed by the harder pressure roll structure when the required pressure is applied therebetween, the pressure being a function of the desired deformation which corresponds to the desired length of the nip 16.

While the outer layer 30 is not adequately abhesive, it has been found desirable to coat this layer with a release agent material 36 contained in a sump 38. The material 36 comprises a polymeric release agent material such as mercapto or amino silicone oil.

For the purpose of coating the heated roll structure 12 there is provided a Release Agent Management (RAM) system generally indicated by reference character 40. The mechanism 40 comprises a donor roll 42, metering roll 44, doctor blade 46 and a wick 48 which is urged into intimate engagement with the metering roll 44 by means of a bias spring 53. The metering roll 44 is partially immersed in the release agent material 36 and is supported for rotation such that it is contacted by the donor roll 42 which, in turn, is supported so as to be contacted by the heated roll structure 12. As can be seen, the orientation of the rolls 42 and 44 is such as to provide a path for conveying material 36 from the sump to the surface of the heated roll structure 12. The metering roll is preferably a nickel or chrome plated steel roll having a 4–32 AA finish. The metering roll has an outside diameter of 1.0 inch. As mentioned above, the metering roll is supported for rotation, such rotation being derived by means of the positively driven heated roll structure 12 via the rotatably supported donor roll 42. In order to permit rotation of (at a practical input torque to the heated roll structure 12) the metering roll 44 in this manner the donor roll 42 comprises a deformable layer 49 which forms a nip 50 between the metering roll and the donor roll. A suitable nip length is about 0.10 inch.

Wick 48 is fully immersed in the release agent and contacts the surface of the metering roll 44. The purpose of the wick is to provide an air seal which disturbs the air layer formed at the surface of the roll 44 during rotation thereof. If it were not for the function of the wick, the air layer would be coextensive with the surface of the roll immersed in the release agent thereby precluding contact between the metering roll and the release agent.

The doctor blade 46 preferably fabricated from Viton is ¾×b 1;8 in cross section and has a length coextensive with the metering roll. The edge of the blade contacting the metering roll has a radius of 0.001–0.010 inch. The blade functions to meter the release agent picked up by the roll 44 to a predetermined thickness, such thickness being of such a magnitude as to result in several microliters of release agent consumption per copy. The donor roll 42 has an outside diameter of 1.0 inch when the metering roll's outside diameter equals 1.0 inch. It will be appreciated that other dimensional combinations will yield satisfactory results. For example, 1.5 inch diameter rolls for the donor and metering rolls have been employed. The deformable layer 49 of the donor roll preferably comprises overcoated silicone rubber. However, other materials may also be employed.

A thin sleeve 54 on the order of several mils, constitutes the outermost surface of the roll 42, the sleeve material comprises Teflon, Viton or any other material that will impede penetration of silicone oil into the silicone rubber. While the donor rolls may be employed without the sleeve 54, it has been found that when the sleeve is utilized, the integrity of the donor roll is retained over a longer period and contaminants such as lint on the heated roll 12 will not readily transfer to the metering roll 44. Accordingly, the material in the sump will not become contaminated by such contaminants.

Figure 1:
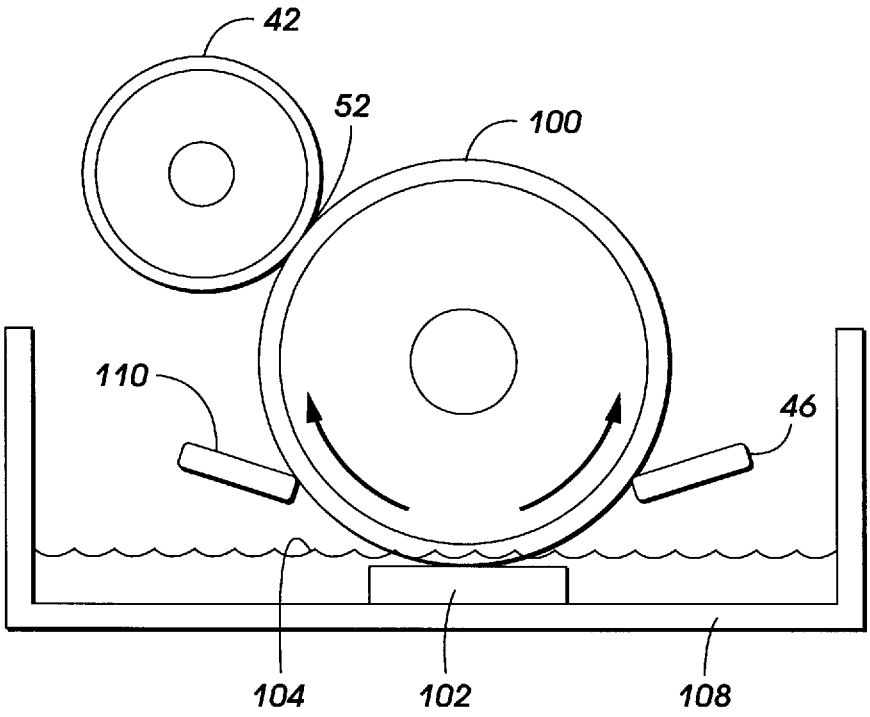
FIG. 1 is a schematic representation of a RAM system for use in a heat and pressure fuser of the type illustrated in FIG. 2.

An oil metering system as shown in FIG. 1 comprises a metering roll 100 supported for contact with a wick 102 and a supply of silicone oil 104 which are contained in a sump 108. The doctor blade 46 is supported at about a 2 o'clock position relative to the metering roll 100 and the silicone oil in the sump 108 is located at the 6 o'clock position. A nip 52 is located at about the 10 o'clock position. A second doctor blade 110 contacts the metering roll 100 at about the 8 o'clock positioned. The exact positions of the nip, silicone oil and blades relative to the metering roll are not critical. However, it is critical to the invention that one doctor blade is disposed intermediate the nip 52 and the supply of silicone oil 104 such that as the metering roll is rotated a quantity of oil picked up from the supply will be metered thereon regardless of whether the direction of rotation of the metering roll is clockwise or counterclockwise. Thus, the doctor blade 46 contacts the metering roll intermediate one side of the nip and the supply of release agent material while the doctor 110 contacts the metering roll intermediate the other side of the nip and the supply of release agent material.

A manually operable jam clearance knob 120 operatively connected to the fuser roll 12 can be rotated in both the clockwise and counterclockwise directions. When the fuser roll is rotated in the direction opposite to the process direction the metering roll is rotated in the clockwise direction whereby the doctor or metering blade 110 prevents excess silicone oil and/or contaminants from being conveyed to the fuser roll 12 from the sump and being deposited thereon. Also, when the metering roll rotates the counterclockwise direction the blade 110 prevents dirt and debris from getting into the sump thereby preventing dirt from plugging wick 102.

We claim:

1. A release agent management structure, said structure comprising:

a donor member;

a supply of release agent material;

a metering member supported for rotation in two directions and in pressure contact with said donor member to form a nip therebetween, said metering member also contacting said supply of release agent material for picking up a quantity of release agent material to be metered; and a metering structure supported in contact with said metering member intermediate said nip and said quantity of release agent material to be metered regardless of direction of rotation of said metering member.

2. A release agent management structure according to claim 1 wherein said metering structure comprises a pair of blade structures.

3. A release agent management structure according to claim 2 wherein one of said blade structures contacts said metering member intermediate one side of said nip and said quantity of release agent material and another of said blade structures contacts said metering member intermediate another side of said nip and said quantity of release agent material.

4. A release agent management structure according to claim 3 wherein said metering member comprises a metering roll.

5. A release agent management structure according to claim 4 wherein said release agent material comprises silicone oil.

6. A heat and pressure fuser, said fuser comprising:

a pair of fuser members between which an imaged substrate passes for fixing of the images thereon;

a release agent management structure including:

a donor member;

a supply of release agent material;

a metering member supported for rotation in two directions and in pressure contact with said donor member to form a nip therebetween, said metering member also contacting said supply of release agent material for picking up a quantity of release agent material to be metered; and a metering structure supported in contact with said metering member intermediate said nip and said quantity of release agent material to be metered regardless of direction of rotation of said metering member.

7. A heat and pressure fuser according to claim 6 wherein said metering structure comprises a pair of blade structures.

8. A heat and pressure fuser according to claim 7 wherein one of said blade structures contacts said metering member intermediate one side of said nip and said quantity of release agent material and another of said blade structures contacts said metering member intermediate another side of said nip and said quantity of release agent material.

9. A heat and pressure fuser according to claim 8 wherein said metering member comprises a metering roll.

10. A heat and pressure fuser according to claim 9 wherein said release agent material comprises silicone oil.

11. A method of metering release agent material on a metering member, said method including the steps of:

supporting a metering member in pressure contact with a donor member to form a nip therebetween, said metering member being movable in two directions;

moving said metering member in contact with a supply of release agent material whereby a quantity of release agent material adheres to its surface;

supporting a metering structure in contact with said metering member intermediate said nip and said quantity of release agent material regardless of the direction of movement of said metering member.

12. A method according to claim 11 wherein said step of supporting a metering structure is effected using a pair of blade structures.

13. A method according to claim 12 wherein said step of supporting a pair of blade structures is effected by supporting one of said blade structures in contact with said metering member intermediate one side of said nip and said quantity of release agent material and another of said blade structures in contact with said metering member intermediate another side of said nip and said quantity of release agent material.

14. A method according to claim 13 wherein said metering member comprises a metering roll.

15. A method according to claim 14 wherein said release agent material comprises silicone oil.

16. A method of fusing toner images to a substrate, said method including the steps of:

providing a pair of fuser members between which an imaged substrate is passed for fixing toner images to the substrate;

metering release agent material on a metering member by:

supporting a metering member in pressure contact with a donor member to form a nip therebetween, said metering member being movable in two directions;

moving said metering member in contact with a supply of release agent material whereby a quantity of release agent material adheres to its surface;

supporting a metering structure in contact with said metering member intermediate said nip and said quantity of release agent material regardless of the direction of movement of said metering member.

17. A method according to claim 16 wherein said step of supporting a metering structure is effected using a pair of blade structures.

18. A method according to claim 17 wherein said step of supporting a pair of blade structures is effected by supporting one of said blade structures in contact with said metering member intermediate one side of said nip and said quantity of release agent material and another of said blade structures in contact with said metering member intermediate another side of said nip and said quantity of release agent material.

19. A method according to claim 18 wherein said metering member comprises a metering roll.

20. A method according to claim 19 wherein said release agent material comprises silicone oil.

* * * * *